US005613608A

United States Patent [19]

Tronchetti et al.

[11] Patent Number: 5,613,608

[45] Date of Patent: Mar. 25, 1997

[54] CONTAINER FOR PAPER SHEETS

[75] Inventors: Sauro Tronchetti, Lucca; Renzo Tronchetti, Lucca, both of Italy

[73] Assignee: Industrie Cartarie Tronchetti S.P.A., Borgo A Mozzano, Italy

[21] Appl. No.: 451,438

[22] Filed: May 26, 1995

[30] Foreign Application Priority Data

Jun. 29, 1994 [IT] Italy ..... MI94A1353
Jun. 29, 1994 [IT] Italy ..... MI94A1354

[51] Int. Cl.[6] ..... B65D 73/00

[52] U.S. Cl. ..... 206/494; 206/233; 206/812

[58] Field of Search ..... 206/494, 233, 206/812; 221/33, 47, 48, 303, 305, 306

[56] References Cited

U.S. PATENT DOCUMENTS

| | | | |
|---|---|---|---|
| 1,901,006 | 3/1933 | Spain | 221/48 |
| 2,433,587 | 12/1947 | Wentworth | 206/494 X |
| 2,826,230 | 3/1955 | Conell | 206/494 |
| 2,841,275 | 7/1958 | Schwimmer et al. | 206/233 |
| 3,021,002 | 2/1962 | Guyer | 206/494 |
| 3,043,472 | 7/1962 | Nemoede | 206/494 X |
| 3,144,961 | 8/1964 | Phenner | 221/48 |
| 3,145,840 | 8/1964 | Wright | 206/494 |
| 4,623,074 | 11/1986 | Dearwester | 206/494 X |
| 4,879,442 | 11/1989 | Giovine | 206/233 |

*Primary Examiner*—David T. Fidei
*Attorney, Agent, or Firm*—McAulay Fisher Nissen Goldberg & Kiel, LLP

[57] ABSTRACT

A container including a top opening and adaped to contain absorbent paper sheets for household or workshops. The opening is arranged longitudinally from one side to the other of the container and is constituted by an almost rectangular central portion, with curved longer sides and rounded corners. The central portion is connected to rectangular lateral portions having a narrower cross-section than the central portion. End portions are connected to the lateral portions and have a substantially trapezoidal shape in which the longer parallel side is directed toward the edge of the container. The container also includes an intermediate supporting panel that is spaced from the resting base so as to prevent the sheets from getting wet if the container is placed on a wet surface.

5 Claims, 5 Drawing Sheets

CONTAINER FOR PAPER SHEETS

BACKGROUND OF THE INVENTION

1. Field of the invention

The present invention relates to a container for paper sheets.

2. Description of the Prior Art

Containers for paper sheets such as handkerchiefs, tissues, and the like, are known and are generally made of cardboard, with an upper opening to allow to pull out a single tissue at a time.

The arrangement of the tissues inside the container and the shape of the opening allow the tissue that follows the one pulled out to arrange itself so that at least one portion lies outside the opening.

The openings of containers for tissues, or for other paper sheets, that are currently commercially available are arranged longitudinally on the top face of the container and generally have a rectangular shape with a constant cross-section or an oval shape.

The opening of conventional containers is not suitable for other kinds of sheet, particularly kitchen paper of the type generally marketed in rolls. Kitchen rolls are in fact made of absorbent paper having a different consistency than tissues.

It is also important that the sheet of absorbent paper is presented flat instead of folded up as occurs for tissues.

There is another important drawback in conventional containers of paper tissues which make them unsuitable for containing sheets of absorbent or cleaning paper. In fact, in the kitchen or workshop the container would often be placed on wet or dirty surfaces and, since the container is made of cardboard, the water and dirt are immediately absorbed by the bottom, spoiling the paper sheets contained in the lower part.

Since a primary function of these kinds of paper sheet is to absorb, it is evident that a very large number of sheets is irreparably ruined.

The aim of the present invention is to provide a container adapted to contain sheets of kitchen, or absorbent paper, for household use or for use in workshops, laboratories, and the like.

A further aim of the invention is to provide a container wherein the single sheets of paper are presented flat for use.

Still a further aim of the present invention is to provide a container that can be made of a material that is not waterproof but can be placed on wet and dirty surfaces without spoiling its contents.

Within the scope of this aim, an object of the invention is to provide a container that is constructively simple and economical.

SUMMARY OF THE INVENTION

This aim, these objects and others, which will become apparent to those skilled in the art, are achieved by a container as claimed in the appended claims.

Further characteristics and advantages of the invention will become apparent from a reading of the detailed description of a preferred but not exclusive embodiment of a container according to the invention, illustrated only by way of a non-limiting example in the accompanying drawings.

DESCRIPTION OF THE PREFERRED EMBODIMENTS OF THE INVENTION

Figure 1:
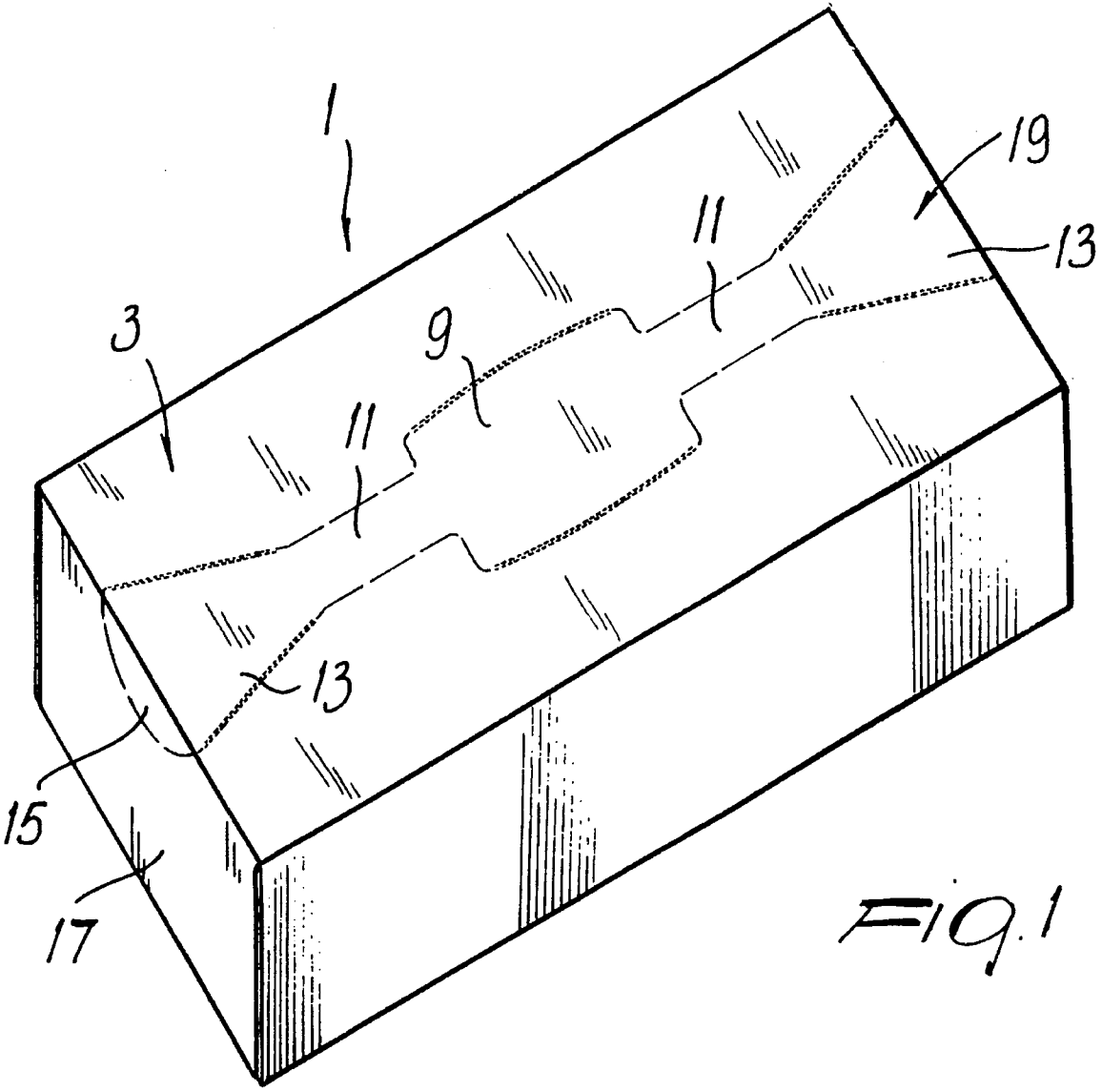
FIG. 1 is a perspective view of the container according to the invention, in which the opening is still closed by the closing strip.
Figure 2:
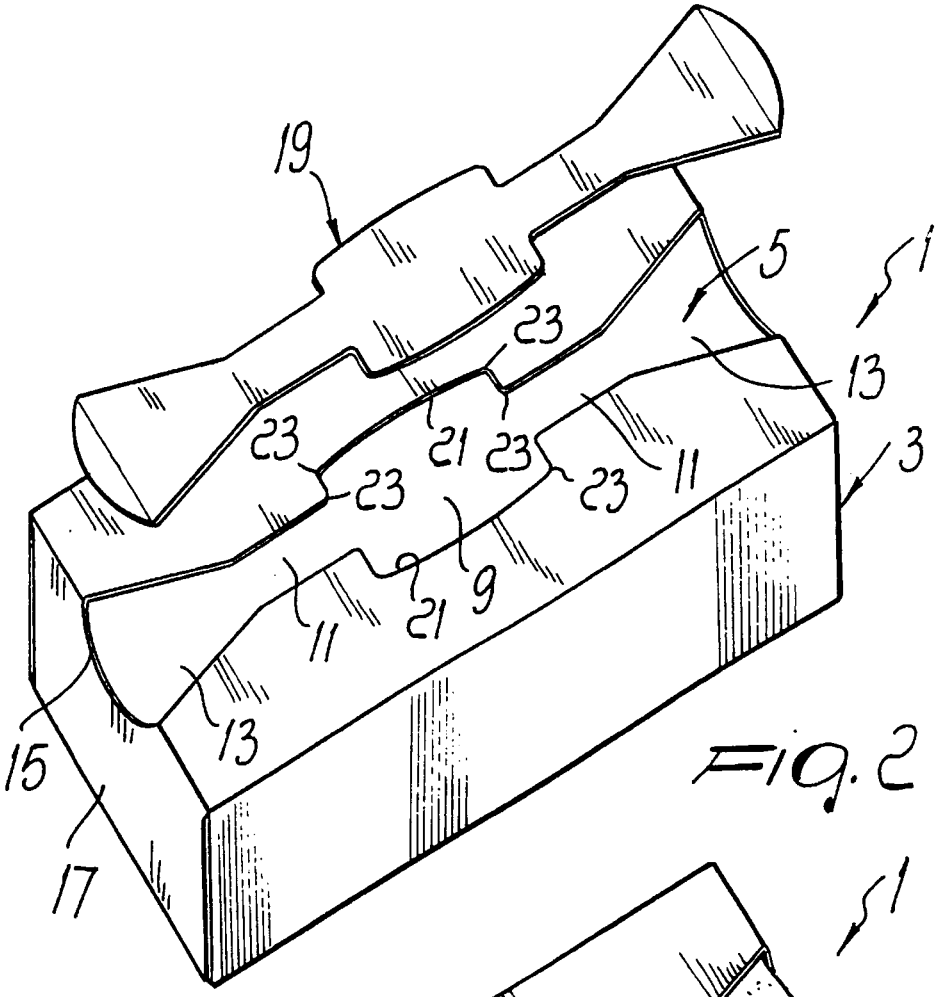
FIG. 2 is an exploded perspective view of the container.
Figure 3:
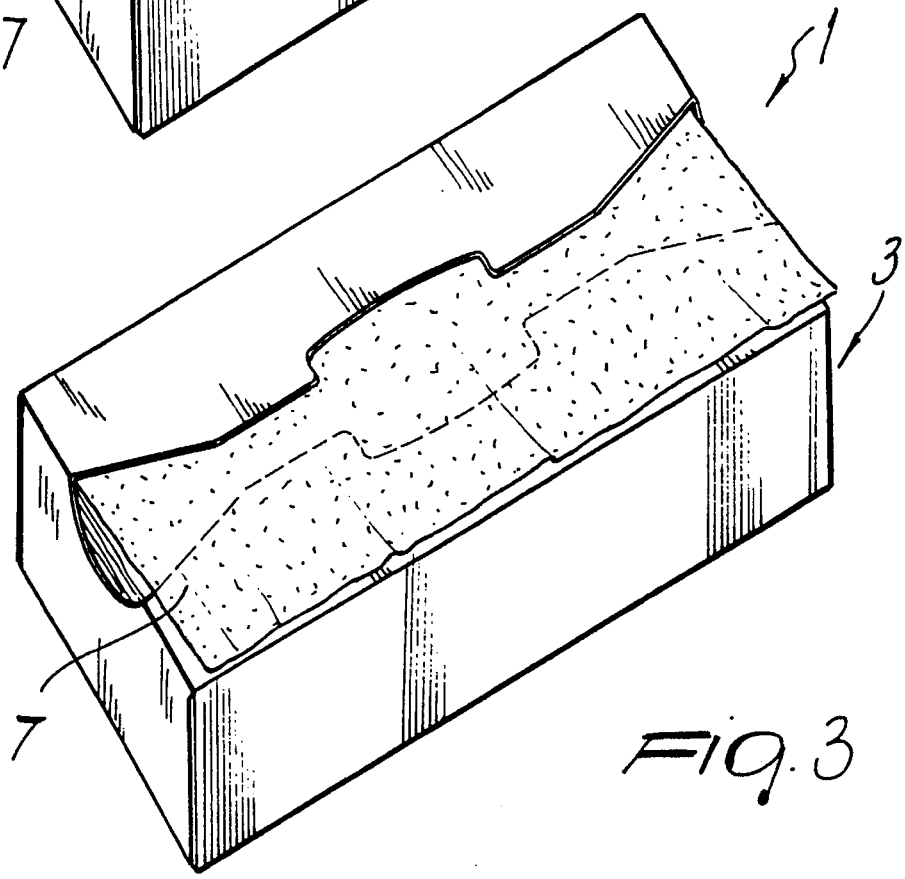
FIG. 3 is another perspective view of the container, shown in its operating position, with a sheet ready to be pulled out.

With reference to FIGS. 1–3 in particular, the container, generally designated by the reference numeral 1, includes a box-like body 3 with a right rectangular prismatic, or box-like, shape having a top opening 5 and is suitable to contain paper sheets 7, such as kitchen or absorbent paper.

The opening 5 runs longitudinally from one side to the other of the box-like body and comprises a quasi rectangular central portion 9 having curved longer sides 21 and rounded corners 23 . The central portion 9 is connected to rectangular lateral portions 11 having a narrower section than the central portion. End portions 13 are connected to the lateral portions 11 and have a substantially trapezoidal shape, in which the longer parallel side is directed towards the edge of the container.

Each one of the end portions 13 includes a vertical portion 15 that runs partially along the vertical wall 17 of the container.

The container is advantageously closed by a strip 19 which is shaped complementarily to the opening 5 and is connected to the container, in a per se known manner, by tearaway portions. FIG. 1 shows the container with the closing strip applied, and the reference numerals related to the opening 5 designate the corresponding portions of the closing strip 19.

Use of the container is very simple. Once the closing strip 19 has been torn off, the first sheet is pulled out, and the next sheet 7 arranges itself flat, as shown in FIG. 3. In this manner it is very easy to grip the sheet in any point and it is possible to pull it out by pulling from any direction by virtue of the configuration of the opening 5.

The wider central portion, shaped in the described manner, ensures that the next sheet is pulled out and positioned properly.

Experimental tests have shown that the presence of the trapezoidal portions 13 at the ends of the opening allows both to easily pull out the sheet regardless of the pulling direction, and to precisely position the next sheet in cooperation with the central portion.

An advantage of the invention resides in the fact that the lateral portions of the opening have a wider section than the mean section of the opening. The main purpose of the wider central portion in fact is to make it easier to grip the sheet when the sheet is gripped centrally.

If required, it is in fact also possible to make the opening without the wider central portion 9.

FIGS. 4–8 show a possible preferred construction of the container according to a further aspect of the invention. The container, generally designated by the reference numeral 101, is made from a cutout 103 comprising: a side portion 105, a top portion 107, a second side portion 109, a resting base 111, a first connecting portion 113, a supporting panel 115, and a second connecting portion 117.

Figure 7:
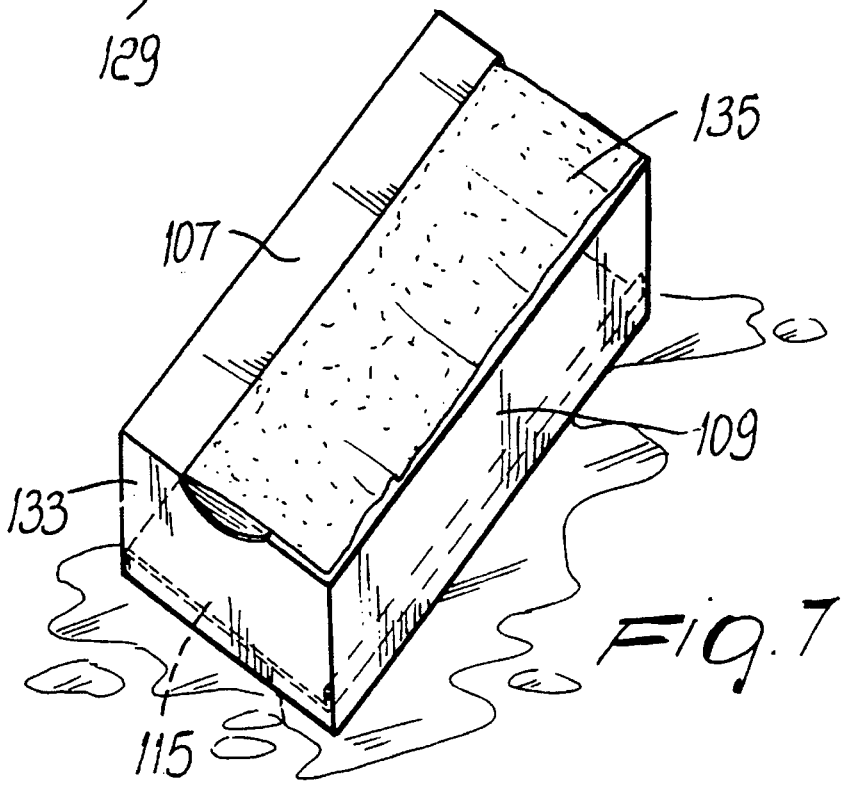
FIG. 7 is a perspective view of the container after assembly and during use.

Flaps 119, 121, 123, and 124 are connected to the free edges of the side portions 105 and 109 and are suitable to cooperate with engagement flaps 127 and 129 that are connected to the free edges of the resting base 111 and with the front and rear portions 131 and 133 that are associated with the top portion 107, so as to close and lock the box-like body in its operating position (shown in FIG. 7).

Figure 4:
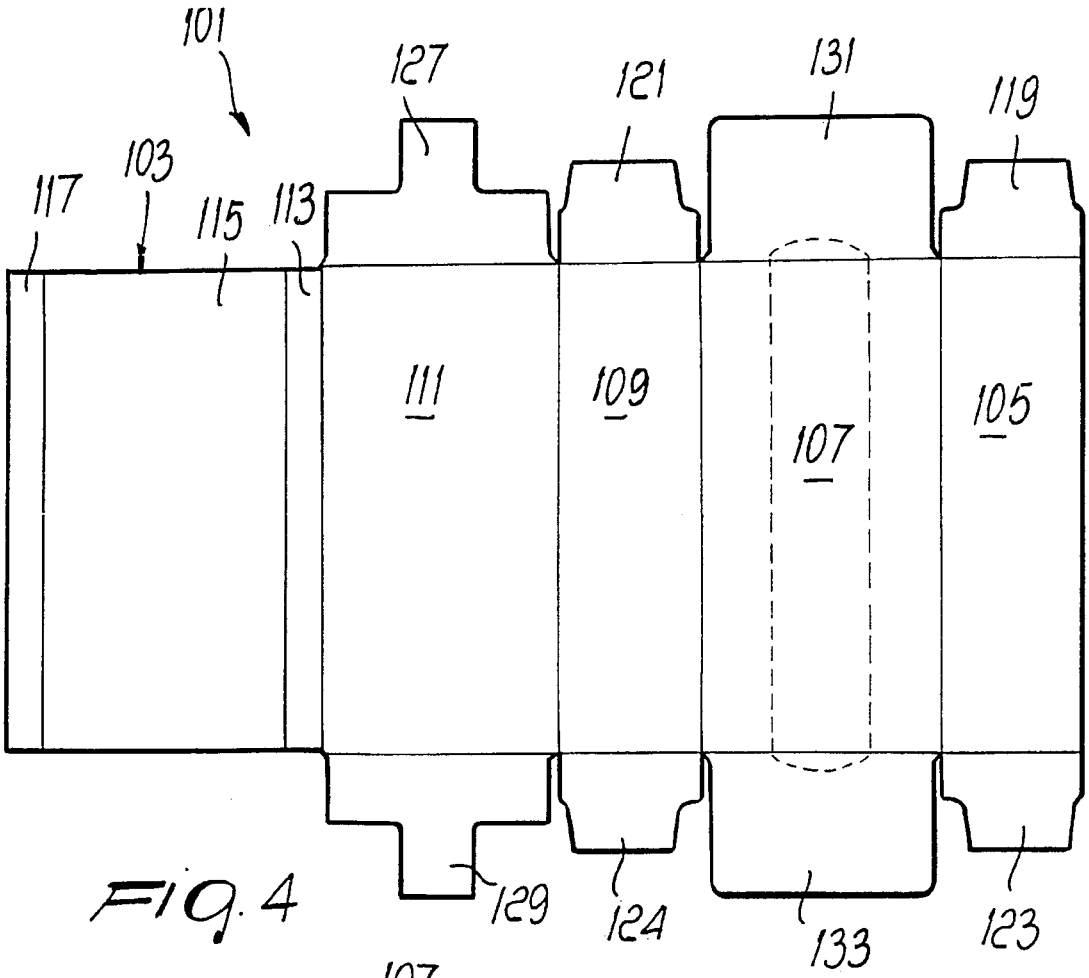
FIG. 4 is a plan view of the cutout that is suitable to constitute the container according to the invention.
Figure 5:
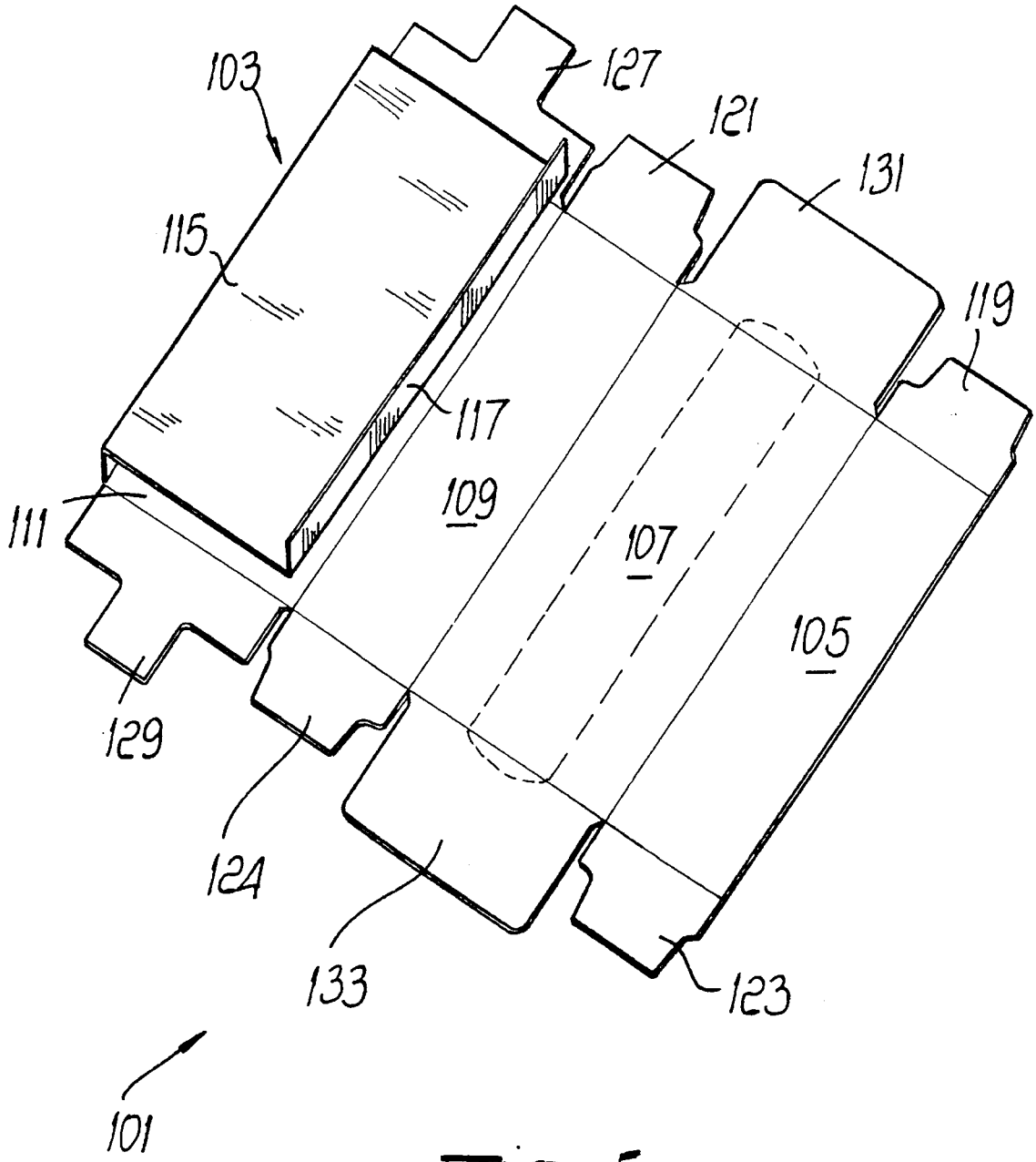
FIG. 5 is a perspective view of the container in a first step of assembly.
Figure 6:
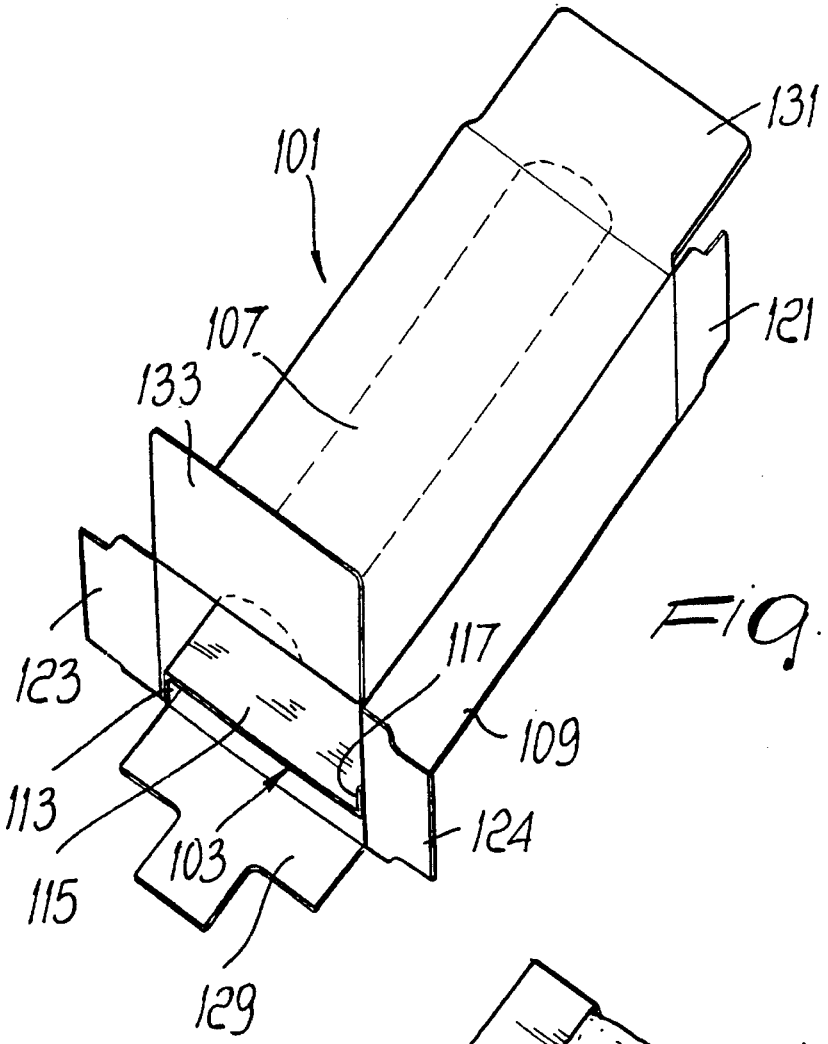
FIG. 6 is a perspective view of the container in a final step of assembly.

Assembly of the box-like body is shown in FIGS. 4 to 6, and includes folding the connecting portions 113 and 117 and the supporting panel 115, as shown in FIG.5. Then the connecting portion 117 is fixed to the side portion 109 for example by gluing. The top portion 107 and the side portion 105 are then folded and closed. The side portion 105 is then fixed to the connecting portion 113. Once the sheets 135 have been loaded inside the container, the front and rear portions 131 and 133 can be closed and locked, for example by gluing, in cooperation with the flaps 119, 121, 123, 124, 127, and 129.

Figure 8:
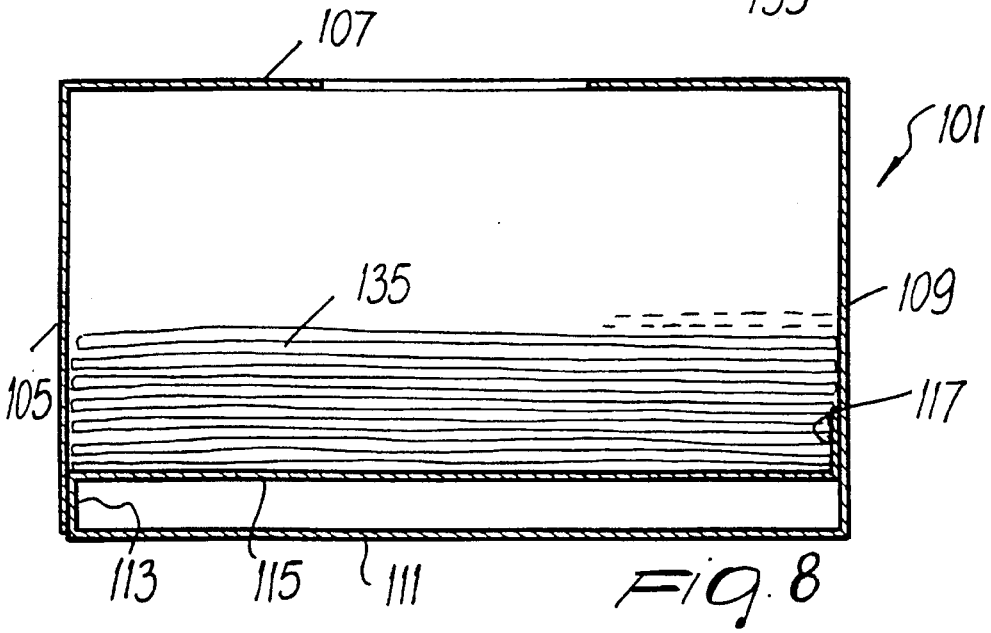
FIG. 8 is a transverse sectional view of the container according to the invention.

The container is thus ready for use, as shown in FIGS. 7 and 8. It should be noted in particular that the intermediate supporting panel 115 keeps the sheets 135 at a certain distance from the resting base 111, so that even if the bottom of the container gets wet the sheets remain completely dry.

It has been seen how the invention achieves the intended aims by providing a container for effectively supplying sheets of absorbent paper for household and workshop use in particular.

The container according to the invention is susceptible to numerous modifications and variations, all of which are within the scope of the inventive concept. All the details may furthermore be replaced with other technically equivalent elements.

In practice, the materials employed, as well as the dimensions, may be any according to the requirements.

Having thus described one particular embodiment of the invention, various alterations, modifications, and improvements will readily occur to those skilled in the art. Such alterations, modifications, and improvements as are made obvious by this disclosure are intended to be part of this disclosure though not expressly stated herein, and are intended to be within the spirit and scope of the invention.

Accordingly, the foregoing description is by way of example only and is not intended as limiting. The invention is limited only as defined in the following claims and the equivalents thereto.

We claim:

1. A container for paper sheets comprising a body for holding paper sheets, said body having an opening extending longitudinally along an upper surface of said body, said opening having a central portion, a pair of end portions, and a pair of lateral portions between and contiguous with said central portion and each of said end portions, said end portions having a width substantially greater than a width of said lateral portions, each of said end portions having a substantially trapezoidal shape having a longer parallel side oriented toward a side edge of said container.

2. A container as defined in claim 1, wherein said central portion is substantially rectangular, said central portion having rounded corners and curved sides, and wherein said lateral portions are substantially rectangular and narrower than said central portion.

3. A container as defined in claim 1, wherein said body has a pair of side walls, said opening extending longitudinally from one of said side walls to another of said side walls, said opening further including a vertical portion in each of said side walls, each of the vertical portions being contiguous with a respective one of said end portions and communicating with an interior of said body.

4. A container as defined in claim 1 wherein said body has the shape of a right rectangular prism, said body having a resting base at a bottom surface thereof and an intermediate supporting panel spaced from said base and positioned between said base and said opening to support paper sheets.

5. A container as defined in claim 4 wherein said body and said intermediate supporting panel are formed of a single folded cutout.

* * * * *